US006994013B2

(12) United States Patent
Ognibene

(10) Patent No.: US 6,994,013 B2
(45) Date of Patent: Feb. 7, 2006

(54) SINGLE-ACTING CYLINDER-PISTON UNIT OF PLUNGER TYPE

(75) Inventor: Olmes Ognibene, Bagnolo In Piano (IT)

(73) Assignee: Ognibene S.p.A., Reggio Emilia (IT)

( * ) Notice: Subject to any disclaimer, the term of this patent is extended or adjusted under 35 U.S.C. 154(b) by 0 days.

(21) Appl. No.: 10/815,655

(22) Filed: Apr. 2, 2004

(65) Prior Publication Data

US 2004/0194620 A1 Oct. 7, 2004

(30) Foreign Application Priority Data

Apr. 4, 2003 (IT) ..... RE20030007 U

(51) Int. Cl.
*F01B 29/00* (2006.01)

(52) U.S. Cl. ..... 92/128

(58) Field of Classification Search ..... 92/128, 92/255, 172

See application file for complete search history.

(56) References Cited

U.S. PATENT DOCUMENTS 2,724,368 A * 11/1955 Miller ..... 92/128
2,967,512 A 1/1961 Born
2,997,026 A * 8/1961 Zimmerer ..... 92/128
3,494,652 A * 2/1970 Langland ..... 92/128
3,528,346 A * 9/1970 Lee ..... 92/128
3,643,551 A * 2/1972 Berg ..... 92/128

FOREIGN PATENT DOCUMENTS

| | | |
|---|---|---|
| EP | 0 902 196 A1 | 3/1999 |
| GB | 812313 | 4/1959 |
| JP | 56080512 | 7/1981 |
| JP | 10169610 | 6/1998 |

* cited by examiner

*Primary Examiner*—Edward K. Look
*Assistant Examiner*—Michael Leslie
(74) *Attorney, Agent, or Firm*—Browdy and Neimark, PLLC

(57) ABSTRACT

Single-acting cylinder-piston unit of plunger type, having a cylinder (1) closed at one end and containing a slidable cylindrical rod (5), the inner end of which presents two adjacent circumferential grooves (18, 28), the first (18) of which acts as a final seat for a split ring (8) defining the limit of the outward stroke of the rod and the second (28) of which acts as a temporary seat for the split ring, enabling the rod with the split ring mounted thereon to be inserted into the cylinder, the second groove (28) being at the inner end of the rod and the first groove (18) being more towards the opposite end of the rod, in proximity to the base, a counteracting member being arranged to interfere with the split ring to cause it to transfer from the second groove to the first groove during the final stage of insertion.

4 Claims, 2 Drawing Sheets

FIG. 1
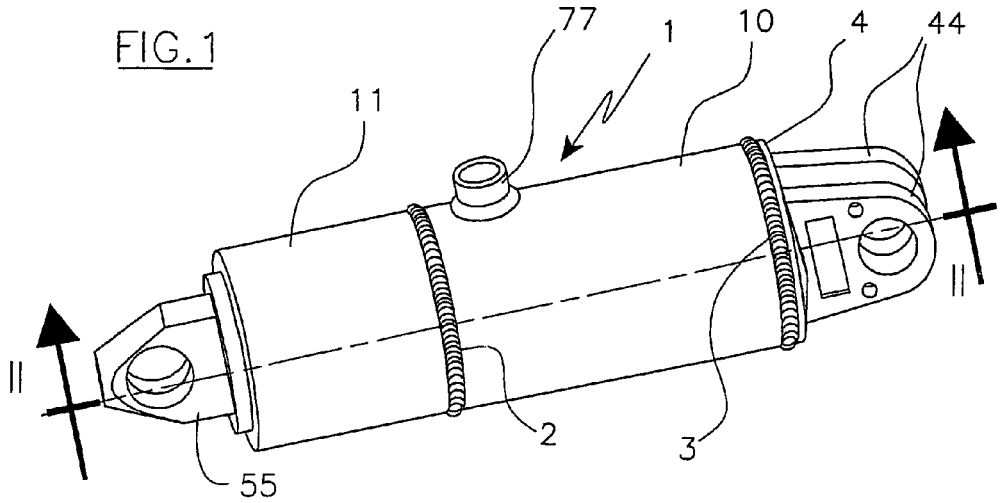
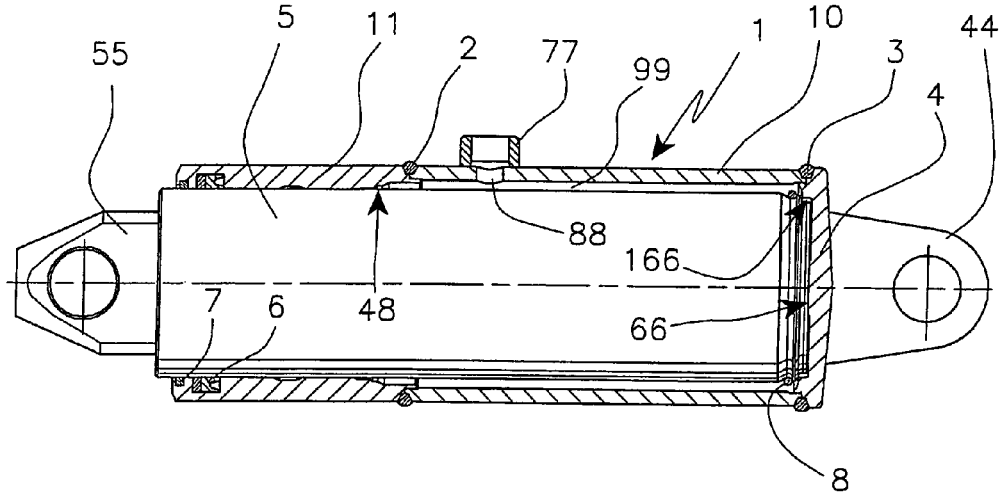
FIG. 2

FIG. 3
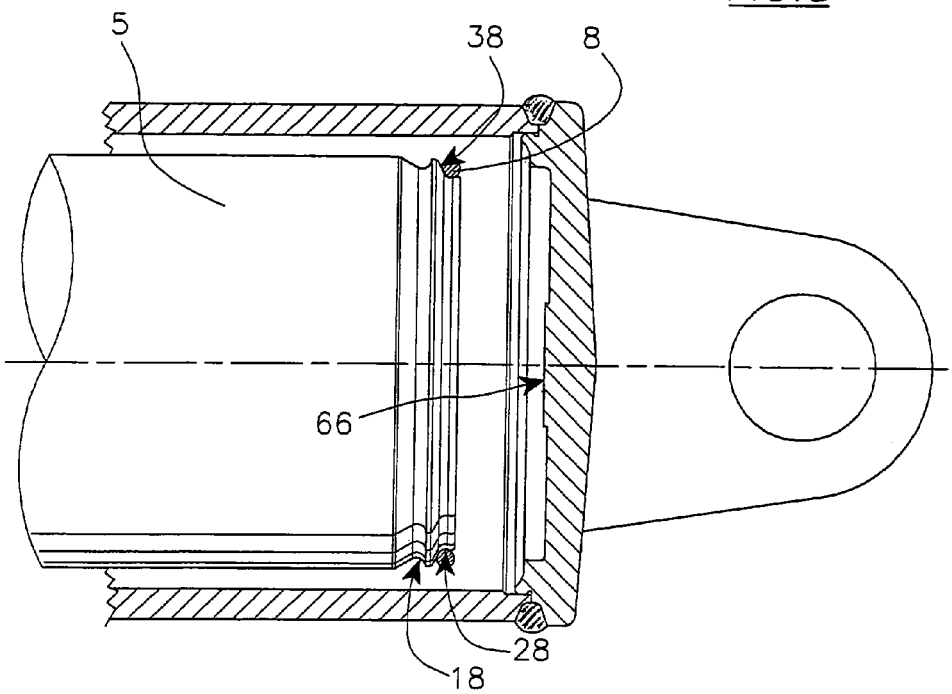
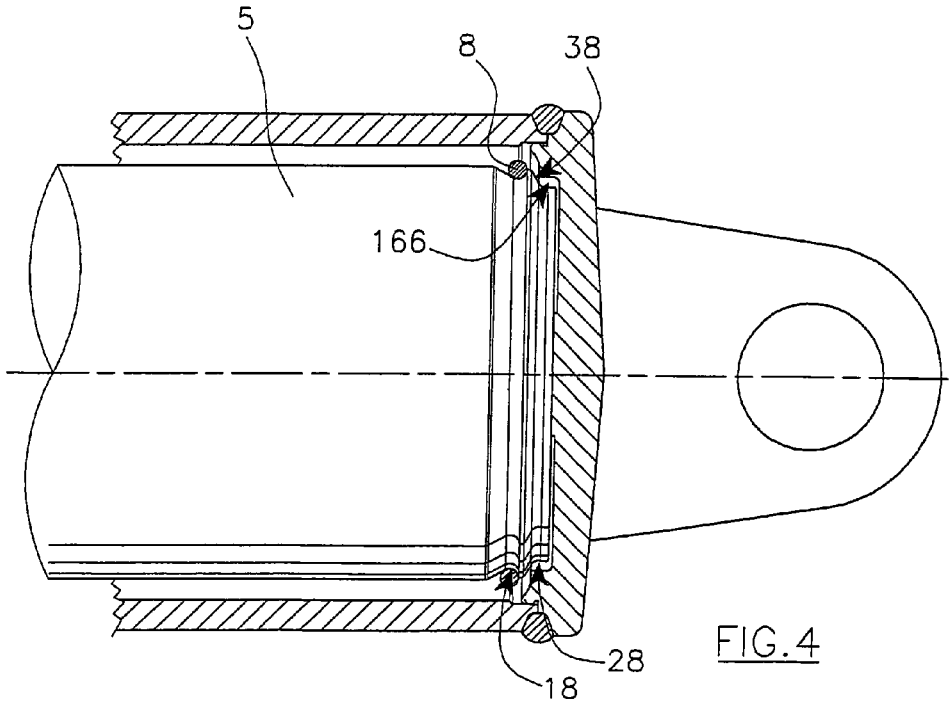
FIG. 4

SINGLE-ACTING CYLINDER-PISTON UNIT OF PLUNGER TYPE

FIELD OF THE INVENTION

The present invention relates to a single-acting cylinder-piston unit of plunger type, used typically but not exclusively on agricultural machines and equipment in general.

Single-acting cylinder-piston units of so-called plunger type are known comprising, essentially, a cylinder closed at one end by a base and containing a generally solid slidable cylindrical rod acting both as the piston rod and as the piston.

The interior of said cylinder comprises two portions of different diameter, one of which, of smaller diameter, is close to the open end of the cylinder and sealedly receives that rod portion acting as the piston rod, while that of larger diameter provides the operating chamber for that rod portion acting as the piston.

The operating fluid for the cylinder-piston unit, generally hydraulic oil, enters and leaves through a radial passage provided in that cylinder part situated at said operating chamber.

The limit of the return stroke of the rod is determined by said base, the limit of its outward stroke being determined by an elastically deformable split ring carried by the rod and intended to rest against a shoulder provided in the connection region between the two different-diameter internal portions of the cylinder.

Said split ring is associated with the inner end of the rod.

Said inner end comprises two adjacent circumferential grooves, of which that situated towards the closed end of the cylinder forms the final operative seat for the split ring, while that situated more towards the open end of the cylinder forms the temporary retention seat for said split ring.

Said seats, or grooves, are shaped and dimensioned such that when the split ring is engaged with the temporary seat its outer generators lie below the outer surface of the rod, whereas when the split ring is engaged with the final seat its outer generators lie above the outer surface of the rod.

To assemble such cylinder-piston units, which is done manually, the split ring is disposed in its temporary seat in the rod and the rod is then inserted into the cylinder, after which the split ring is transferred from its temporary to its final seat.

To achieve this, the cylinder is conveniently temporarily blocked, then the rod is moved to align the split ring with that cylinder passage provided for the entry and exit of the operating fluid, then using a suitable tool inserted through said passage the split ring is held firmly, while simultaneously using another convenient tool to subject the rod to translational and rotational movements until the split ring is compelled to widen out and move from its temporary to its final seat.

As stated the said operations are carried out manually, involving lengthy and tiring work, especially if the cylinder-piston unit is of relatively large diameter, using split rings in the form of a filiform element which is correspondingly thicker and stronger, and hence particularly difficult to open out and shift in the aforesaid manner.

SUMMARY OF THE INVENTION

The main object of the present invention is to provide means for simplifying and accelerating the assembly of such cylinder-piston units of plunger type.

Another object is to achieve said aim within the context of a simple, rational, reliable and economical construction.

These objects are attained by virtue of the characteristics indicated in the claims.

In a totally general sense, the cylinder-piston unit of the invention is formed in such a manner that the passage of the split ring from its temporary retention seat to its final operating seat takes place automatically on inserting the rod into the cylinder.

In particular, the mutual position of said two seats is inverted relative to that of the known art, i.e. according to the teachings of the invention said temporary seat and said final seat are situated the first towards the closed end of the cylinder and the second more towards the open end of the cylinder.

In addition at said closed end there is positioned a fixed counteracting member against which the split ring rests when the rod is nearly fully inserted into the cylinder, by which the split ring is firstly retained, then compelled to widen out by the moving rod so as to leave its temporary seat, and is finally left free to contract automatically to engage its final seat.

Said counteracting member, described in detail hereinafter, is preferably associated with the cylinder base, and more preferably is formed in one piece therewith.

The initially stated problem is overcome by the aforedescribed means. In this respect, the assembler has merely to insert into the cylinder the rod with the split ring positioned in its temporary seat, after which the split ring is transferred from its temporary to its final seat without him having to make any effort to hold the split ring firmly or to maneuver the rod.

As stated, the said transfer takes place automatically and very simply, for example it is sufficient to provide a workbench with a sort of clamping unit, or an equivalent means such as a cylinder retention stop with an associated pusher, able to fully insert the rod into the cylinder.

The characteristics and the constructional merits of the invention will be apparent from the ensuing detailed description given with reference to the figures of the accompanying drawings.

BRIEF DESCRIPTION OF THE DRAWINGS

FIG. 1 is a perspective view showing a cylinder-piston unit according to the invention.

FIG. 2 is the section 11—11 of FIG. 1 on an enlarged scale.

FIG. 3 is a partial section showing the closed end of the cylinder-piston unit before passage of the split ring from its temporary seat to its final seat.

FIG. 4 is a view similar to FIG. 3, but showing the split ring in its final operative seat.

DESCRIPTION OF THE PREFERRED EMBODIMENT

Said figures, and in particular FIGS. 1 and 2, show a single-acting cylinder-piston unit of plunger type comprising a cylinder 1 within which a cylindrical rod 5 is slidably inserted.

As stated in the introduction, a part of the cylindrical rod 5 (that to the left in FIG. 2) forms the piston rod of the cylinder-piston unit, whereas the remaining part (that to the right in FIG. 2) forms the piston of the cylinder-piston unit.

The cylinder 1 consists of two parts, the rear part indicated by 10 and the front part indicated by 11, they being joined together by a circumferential weld 2.

The cylinder 1 is closed by a base 4 which is joined to the part 10 by a circumferential weld 3, and is provided with two external holed lugs 44 (FIGS. 1 and 2).

Between the cylinder 1 and the rod 4 there is defined an operating chamber 99 connected to an external hydraulic service source by a radial hole 88 provided in the part 10, with which a threaded connector 77 is associated.

Between the part 11 and the rod 5 there are interposed a seal gasket 6 with relative anti-extrusion ring, and a scraper ring 7 (see FIG. 2), said rod emerging from said part 11, where it presents a holed lug 55.

As can be seen in FIGS. 2 to 4, the flat connection part of the base 4 comprises an internal cyathiform element 166 the purpose of which is described hereinafter.

On the bottom of said cyathiform element 166 there is a central pad 66 having two functions.

One is to define the return stroke limit of the rod 5, the other being to provide between the rod 5 and the cyathiform element 166 a toroidal port enabling pressurized oil, when said rod is completely retracted, to reach the region between the base 4 and the facing transverse face of the rod 5 (see FIG. 4).

With regard to the outward stroke limit of said rod 5, this is defined by an elastically deformable split ring 8 positioned on the inner end of the rod 5, to rest against a re-entering circumferential shoulder 48 (see FIG. 2) provided on the inner surface of the cylinder 1.

At said inner end of the rod 5 there are provided two adjacent circumferential grooves 18 and 28 respectively, between the adjacent sides of which there is a frusto-conical portion 38.

According to the invention, the first 18 of said grooves is situated more towards the open end of the cylinder 1 to form the final operative seat for the split ring 8, whereas the second groove 28 is situated towards the closed end of the cylinder 1 to form the temporary retention seat for said split ring 8.

Specifically, when the split ring 8 is engaged with the groove 18 its external generators lie beyond the outer surface of the rod 5, to define said outward stroke limit for said rod 5 (see FIGS. 2 and 4).

In contrast, when the split ring 8 is engaged with the groove 28 (see FIG. 3). its external generators lie below the outer surface of the rod 5, this configuration corresponding to that which the rod 5 has to present to be able to be inserted into the cylinder 1 on assembling the cylinder-piston unit.

As also stated in the introduction, passage of the split ring 8 from its temporary seat in the groove 28 to its final seat in the groove 18 takes place automatically during said assembly by virtue of the cyathiform element 166 on the base 4 which acts as a counteracting member for the split ring 8.

In this respect said cyathiform element 166 provides a recess able generally to receive the terminal portion of the rod 5 presenting the groove 28.

By this means, when the rod 5 is being fully inserted into the cylinder 1, the split ring 8 initially rests against said cyathiform element, where it is retained, and is hence compelled to leave the groove 28 and to slide along the frusto-conical portion 38, with simultaneous widening, to finally enter the groove 18 and be elastically clamped against its base.

The merits and advantages of the invention are apparent from the aforegoing and from an examination of the accompanying figures.

What is claimed is:

1. A single-acting cylinder-piston unit of plunger type, comprising a cylinder (1) closed at one end by a base (4) and containing a slidable cylindrical rod (5), the inner end of which presents two adjacent circumferential grooves (18, 28), the first (18) of which acts as a final seat for a split ring (8) defining the limit of the outward stroke of said rod, and the second (28) of which acts as a temporary seat for the said split ring enabling the rod with the split ring mounted thereon to be inserted into the cylinder, said second groove (28) being situated at the inner end of said rod while said first groove (18) is situated more towards the opposite end of said rod, in proximity to said base there being provided a counteracting member which during the final stage of the total insertion of the rod into the cylinder is arranged to interfere with the split ring in order to cause it to transfer from said second groove to said first groove, wherein said second groove is configured to form a retention seat for said split ring and is dimensioned to hold said split ring so that the external generators of said split ring lie below the outer surface of said rod, thereby allowing said split ring to be inserted with said rod into said cylinder during assembly of said cylinder-piston unit, and said first groove is dimensioned to hold said split ring so that the external generators of said split ring lie beyond the outer surface of said rod.

2. A cylinder-piston unit as claimed in claim 1, characterized in that said counteracting member is formed in one piece with said base.

3. A cylinder-piston unit as claimed in claim 2, characterized in that said counteracting member comprises a cyathiform element which is shaped and dimensioned such as to receive at least the terminal rod portion on which said second groove is provided.

4. A cylinder-piston unit as claimed in claim 1, characterized in that the adjacent sides of said two grooves are joined by a generally frusto-conical portion able to facilitate the passage of said split ring from the second to the first groove.

* * * * *